United States Patent [19]

Bode, Jr.

[11] 3,937,372

[45] Feb. 10, 1976

[54] SLIDING GATE MECHANISM WITH SIDE WALL MOUNTED BIASING SPRINGS

[75] Inventor: Charles H. Bode, Jr., Bethel Park Borough, Pa.

[73] Assignee: United States Steel Corporation, Pittsburgh, Pa.

[22] Filed: Oct. 25, 1974

[21] Appl. No.: 518,658

[52] U.S. Cl. ..... 222/504; 222/512; 222/561; 251/144

[51] Int. Cl.[2] ..... B22D 37/00; B22D 41/08

[58] Field of Search ..... 266/42, 38; 251/144; 222/504, 512, 561, DIG. 7

[56] References Cited

UNITED STATES PATENTS 506,328 10/1893 Morris ..... 222/561 X

FOREIGN PATENTS OR APPLICATIONS 71,825 2/1893 Germany ..... 266/42

*Primary Examiner*—Robert B. Reeves
*Assistant Examiner*—David A. Scherbel
*Attorney, Agent, or Firm*—Walter P. Wood

[57] ABSTRACT

A slidable gate mechanism for controlling flow of material from an outlet in the bottom wall of a vessel. The gate is mounted in a carrier which is supported for sliding movement under the bottom wall. Springs mounted on a side wall of the vessel act on the carrier to urge the gate upwardly toward the bottom wall. The springs are remote from the outlet and do not require air-cooling.

8 Claims, 5 Drawing Figures

SLIDING GATE MECHANISM WITH SIDE WALL MOUNTED BIASING SPRINGS

This invention relates to an improved slidable gate mechanism for controlling flow of material from a bottom-pour vessel, particularly liquid metal from a ladle or tundish.

It is known to use slidable gates in lieu of the once more common stopper rods for controlling flow of metal from bottom-pour vessels, such as ladles and tundishes. Shapland et al application Ser. No. 377,385, filed July 9, 1973, now U.S. Pat. No. 3,901,418 as a continuation of application Ser. No. 150,585, filed June 7, 1971 (now abandoned) and Klaus et al application Ser. No. 300,957, filed Oct. 26, 1972, all of common ownership, show gate mechanisms intended mainly for use on ladles. The gate mechanism of the present invention is an improvement over the mechanisms shown in these applications.

A conventional slidable gate construction includes a stationary refractory top plate and a movable refractory gate. The top plate underlies the bottom wall of a vessel and has an orifice aligned with the vessel outlet. The gate is supported beneath the top plate, and in the type of mechanism to which my invention relates, has both a closed area and an orifice. The gate can move back and forth to position its closed area in line with the orifice in the top plate to close the vessel outlet, or to position the two orifices in line to permit pouring. The gate must be held firmly against the top plate to prevent leakage of material therebetween, yet must be free to slide.

In the constructions shown in the aforementioned applications, the gate is mounted in a metal carrier which contains a plurality of springs acting on the underside of the gate and urging it upwardly against the top plate. The springs are arranged in a pattern surrounding the gate orifice. Since the springs are located near the pouring stream of liquid metal, they must be air-cooled to prevent early failure. Even with cooling, the springs are short-lived. There is also a problem in adjusting and balancing the forces exerted by the springs on the gate.

An object of my invention is to provide an improved gate mechanism embodying spring means to hold the gate in contact with the top plate, but in which the spring means are remote from the pouring stream and do not require air-cooling.

A further object is to provide an improved gate mechanism in which the forces exerted by the springs are readily adjusted and balanced, and in which the springs always apply a force directly on the transverse center line of the gate regardless of the position of the gate.

A more specific object is to provide an improved gate mechanism, both the operating cylinder (or equivalent linear-motion device) and springs of which are located on the side wall of a vessel and are mechanically connected respectively to the gate carrier and to an interior frame pivotally attached to an exterior frame.

Figure 1:
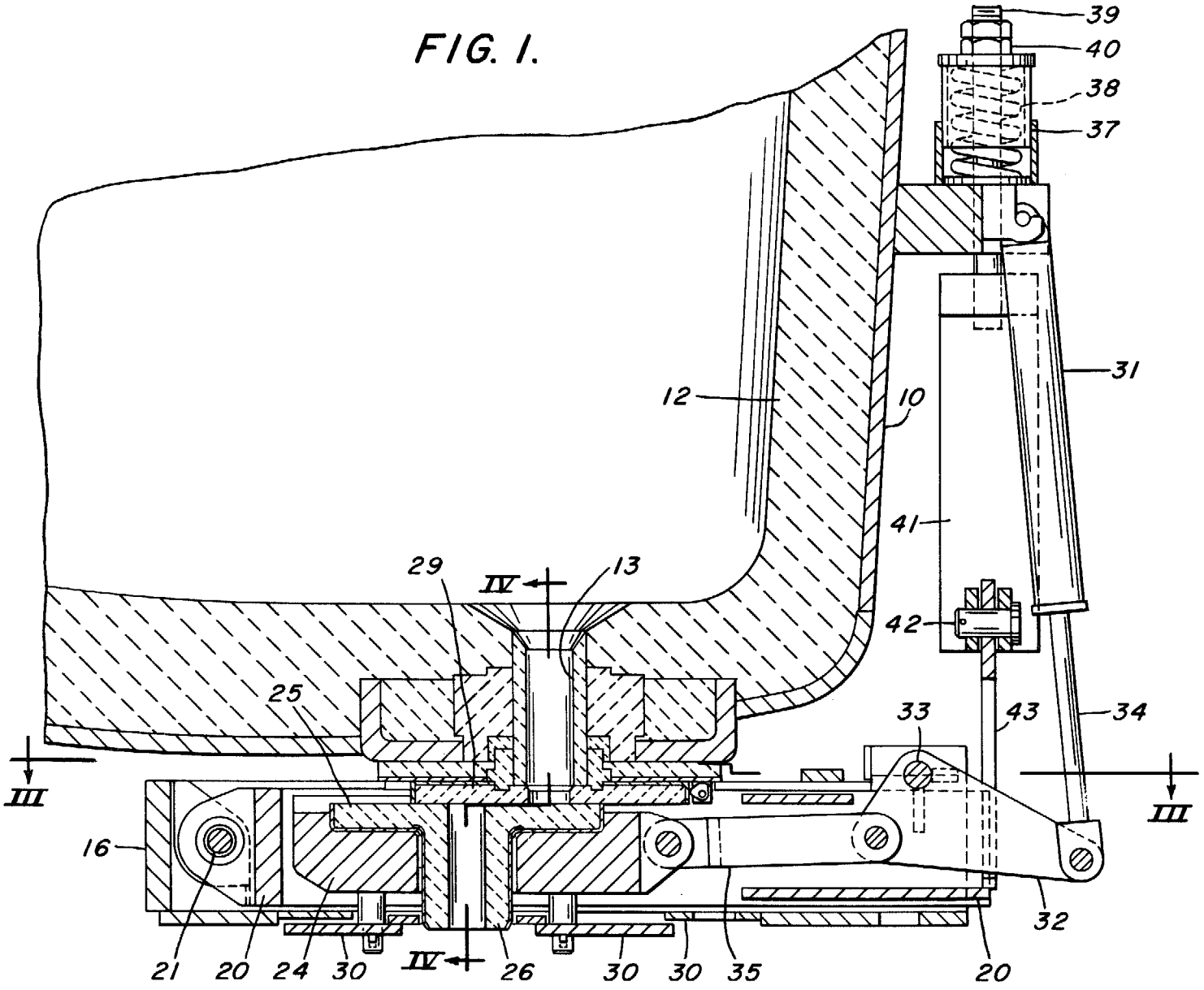
FIG. 1 is a longitudinal vertical sectional view of a portion of a bottom-pour vessel which is equipped with a gate mechanism constructed in accordance with my invention.

FIG. 1 shows a portion of a conventional bottom-pour vessel which includes a metal shell 10 and a refractory lining 12. The bottom wall of the vessel has an outlet 13. The vessel illustrated is a ladle for handling liquid metal.

Figure 2:
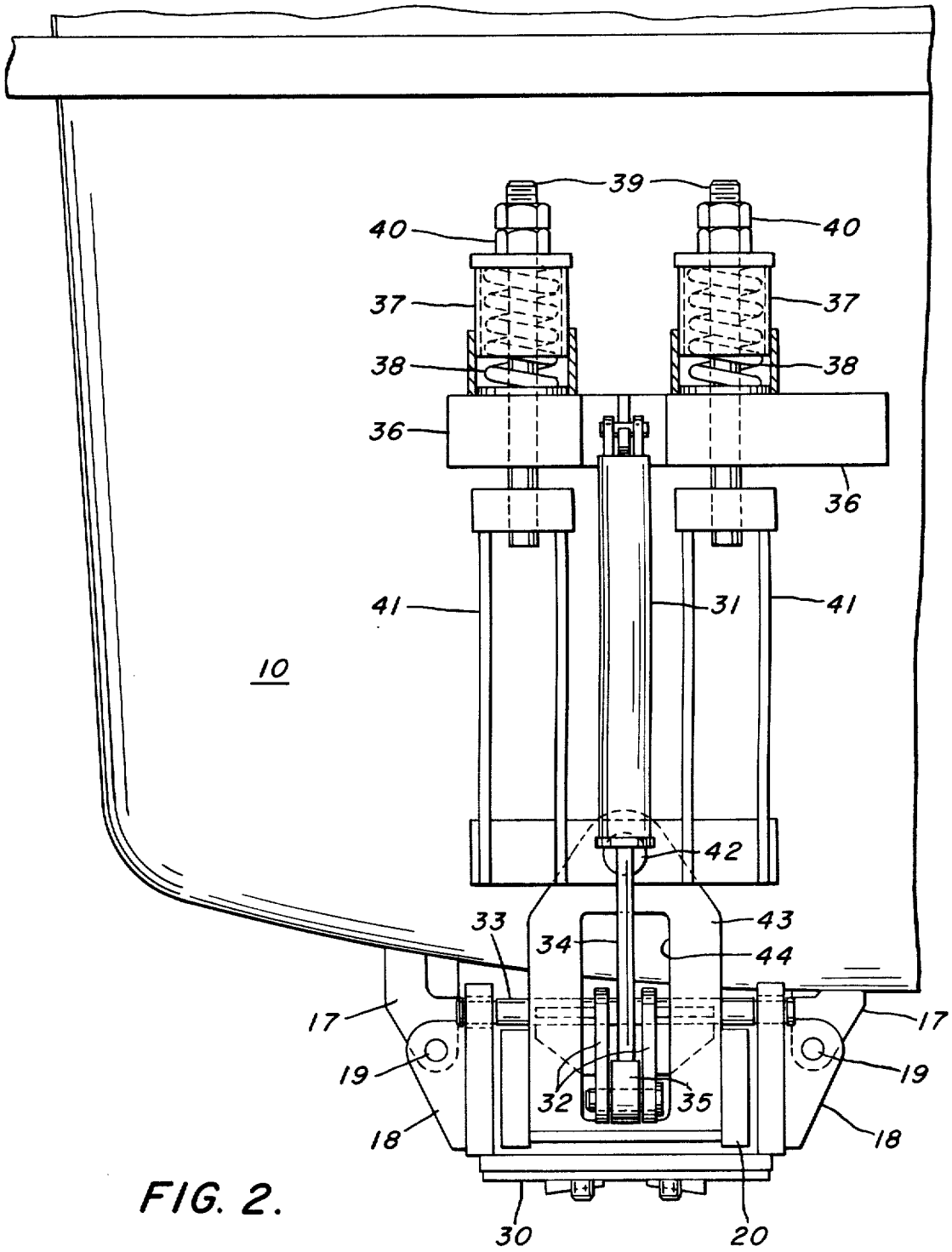
FIG. 2 is an end elevational view of the vessel and gate mechanism from the right of FIG. 1.
Figure 3:
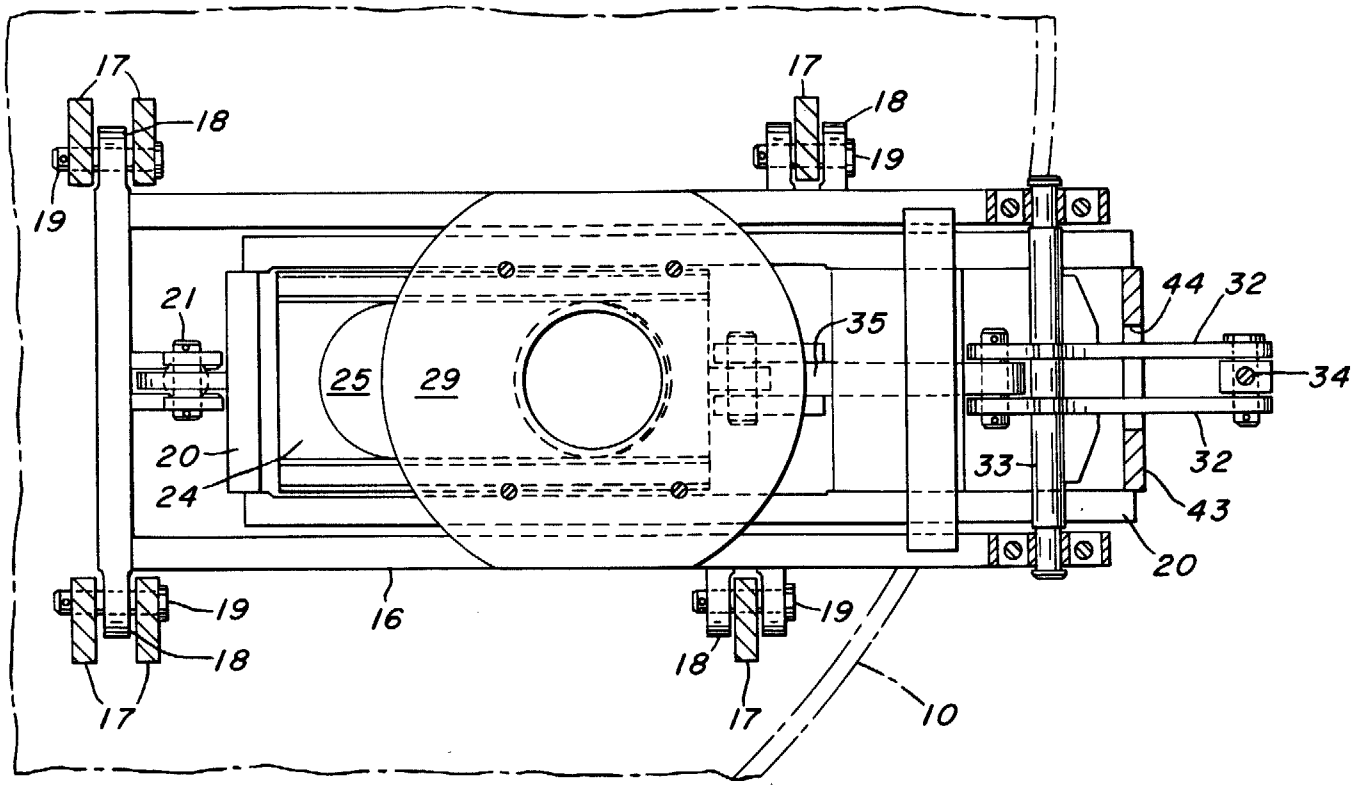
FIG. 3 is a horizontal section on line III—III of FIG. 1.

The gate mechanism of my invention includes a relatively stationary exterior frame 16 rectangular in plan supported on a plurality of pivot ears 17 which depend from the underside of the shell 10 and are fixed thereto. As best shown in FIGS. 2 and 3, frame 16 has outwardly projecting lugs 18. Pins 19 are removably inserted through aligned holes in the ears and lugs, whereby the frame and parts carried thereby can be removed or hingedly opened to afford access to the parts inside. As best shown in FIG. 1, a relatively stationary interior frame 20, also rectangular in plan, is housed within the exterior frame 16 and is pivoted thereto at its back end, as indicated at 21.

Figure 4:
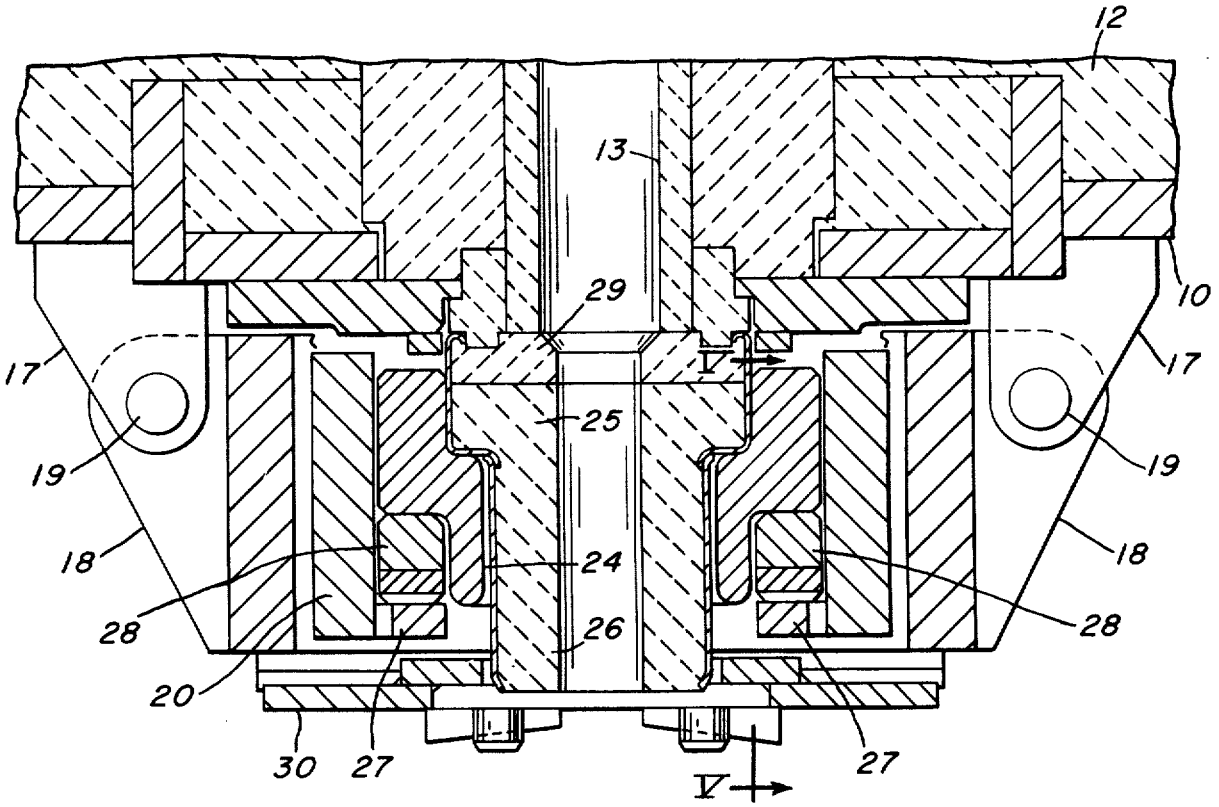
FIG. 4 is a vertical section on line IV—IV of FIG. 1.
Figure 5:
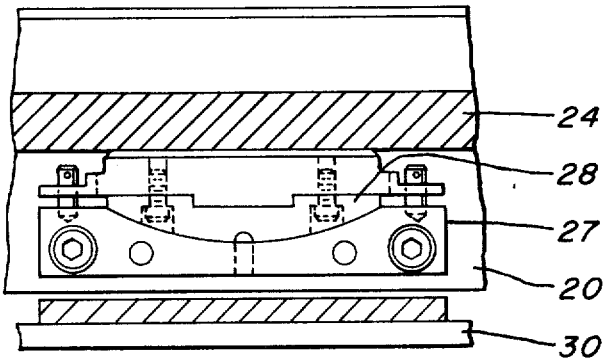
FIG. 5 is a vertical section on line V-V of FIG. 4.

A gate carrier 24 is housed within the interior frame 20 and carries a refractory gate 25 and integral collector nozzle 26 (FIG. 1). As best shown in FIGS. 4 and 5, a pair of opposed upwardly concave supporting ledges 27 are rigidly fixed to the inside faces of the longitudinal side members of the interior frame 20. Respective downwardly convex rockers 28 are received in the concave upper faces of the ledges 27. The upper faces of rockers 28 are flat and slidably support the gate carrier 24 and gate 25. A stationary top plate 29 is positioned under the vessel outlet in contact with gate 25. The underside of the exterior frame 16 and carrier 24 are equipped with conventional heat shields 30.

The motive means for moving the gate and its carrier back and forth preferably is constructed similarly to that shown and claimed in the aforementioned Klaus et al application. This means includes a double-acting fluid pressure cylinder 31 or equivalent linear motion device removably supported on a side wall of the vessel. A bell crank 32 is pivoted to the exterior frame 16 on a transverse shaft 33 near the lower edge of the vessel. One arm of the bell crank is pivotally connected to a piston rod 34 which extends from cylinder 31. A connecting rod 35 is pivotally connected at its ends to the other arm of the bell crank 32 and to the gate carrier 24. This motive means affords advantages that it is out of the way, and further that the bell crank has a mechanical advantage over a cylinder connected directly to the gate carrier, whereby a smaller cylinder suffices.

In accordance with my invention, as best shown in FIG. 2, the side wall of the vessel carries a pair of lugs 36 located a substantial distance above its lower edge at opposite sides of cylinder 31. The lugs carry respective telescoping spring housings 37 which contain compression springs 38 located remote from the gate. Respective bolts 39 extend through the springs and carry nuts 40 at their upper ends. The force which the springs exert can be adjusted and balanced by adjusting these nuts. The lower ends of bolts 39 are connected to a frame 41, which is connected through a removable pin 42 to a yoke 43. The yoke has a central opening 44 to accommodate the bell crank 32 or other motive means. The yoke is attached to opposite sides of the interior frame 20. Cylinder 31 and pin 42 can be removed to enable the exterior frame 16 to be opened or removed.

In operation, springs 38 urge the bolts 39, frame 41 and yoke 43 upwardly. The yoke transmits the force exerted by the springs to interior frame 20 which thus is urged upwardly about its pivotal connection 21 to the exterior frame 16. The interior frame in turn transmits this force to the carrier 24 to hold the gate 25 in contact with the top plate 29. The rockers 28 can rock against the ledges 27 to transmit this force uniformly to the carrier at the transverse center line of the gate regardless of the position which the carrier occupies relative to the vessel outlet.

From the foregoing description, it is seen that my invention affords a simple effective gate mechanism, which not only avoids need for air-cooling of the springs used to hold the gate in contact with the top plate, but which also enables the force exerted by these springs to be adjusted readily. While I have shown a motive means for the gate mounted on the side wall of the vessel, my invention can be used with other forms of motive means, such as that shown in the aforementioned Shapland et al application.

I claim:

1. The combination of a bottom-pour vessel having an outlet in its bottom wall, a gate, means on the bottom wall slidably supporting said gate, whereby said gate may control flow of material through said outlet, and motive means for moving said gate back and forth to open and close said outlet, with a mechanism urging said gate upwardly with respect to said bottom wall, said mechanism comprising at least one spring, means on the side wall of the vessel supporting said spring on the side wall of the vessel at a location remote from said gate, and force-transmitting means connecting said spring with said gate.

2. A combination as defined in claim 1 in which said mechanism further comprises an exterior frame fixed to said bottom wall, an interior frame within said exterior frame pivoted thereto, and a gate carrier slidably supported in said interior frame, said gate being mounted in said gate carrier, said motive means being connected to said gate carrier, said force-transmitting means being connected to said interior frame.

3. A combination as defined in claim 2 in which there are two springs spaced apart on said side wall, and including means accessible at said side wall for balancing and adjusting the force exerted by said springs on said gate.

4. A combination as defined in claim 2 further comprising rocker means supporting said carrier on said interior frame, whereby said spring holds said gate uniformly regardless of the position which carrier occupies relative to the vessel outlet, the spring force being applied at the transverse center line of said gate.

5. A combination as defined in claim 2 in which there are two springs spaced apart on said side wall, and in which said force-transmitting means includes respective bolts acted on by said springs, a frame to which said bolts are connected, and a yoke pivoted to said last-named frame, and connected to said interior frame.

6. A combination as defined in claim 5 in which said bolts carry nuts accessible from outside said vessel for adjusting and balancing the force exerted by said springs.

7. In a slidable gate mechanism for controlling flow of material from an outlet in the bottom of a vessel, which mechanism includes a gate carrier, a gate mounted in said carrier, means supporting said carrier and gate for sliding movement relative to said outlet, motive means connected to said carrier, and spring means urging said gate upwardly toward the vessel bottom, the improvement in which said spring means is located on a side wall of the vessel remote from said outlet, and including force-transmitting means connecting said spring means and said carrier.

8. An improvement as defined in claim 7 including means for applying the force of said spring means to said gate at the transverse center line of the gate regardless of the position said gate occupies relative to said outlet.

* * * * *